US005265854A

United States Patent [19]

Whiteford

[11] Patent Number: 5,265,854

[45] Date of Patent: Nov. 30, 1993

[54] SELF-POWERED BAR CLAMP

[76] Inventor: Carlton L. Whiteford, 3 High Point Rd., Westport, Conn. 06880

[21] Appl. No.: 962,891

[22] Filed: Oct. 19, 1992

[51] Int. Cl.[5] ..... B25B 1/00

[52] U.S. Cl. ..... 269/3; 269/166; 269/254 R; 269/221

[58] Field of Search ... 269/254 R, 254 CS, 166–171.5, 269/147–149, 221, 3, 6

[56] References Cited

U.S. PATENT DOCUMENTS

| | | | |
|---|---|---|---|
| 427,300 | 5/1890 | Carroll | 269/254 R |
| 437,403 | 9/1890 | Nacke et al. | 269/221 |
| 2,319,377 | 5/1943 | Wallace et al. | 269/254 CS |
| 3,044,512 | 7/1962 | Jones | 269/254 |
| 3,218,058 | 11/1965 | Smith | 269/254 CS |
| 3,245,677 | 4/1966 | Hurd et al. | 269/254 CS |
| 3,331,111 | 7/1967 | Carver | 269/171 |
| 4,078,781 | 3/1978 | Fraser et al. | 269/171 |

*Primary Examiner*—Robert C. Watson
*Attorney, Agent, or Firm*—Spencer E. Olson

[57] ABSTRACT

A hand tool or clamp, which locks itself to a work-piece to thereby free the hands of the user, includes a fixed jaw secured to one end of a slide bar and a movable jaw mounted to the slide bar for movement therealong toward and away from the fixed jaw. The movable jaw is normally spring-biased toward the fixed jaw by a flat coil spring supported on the fixed jaw and connected at its free end to the movable jaw. The spring is uncoiled as the jaws are pulled apart to receive a work-piece, and when either jaw is released, rewinds and rapidly advances the movable jaw along the slide bar into clamping engagement with the work-piece. Additional clamping pressure is provided by a screw mechanism associated with the movable jaw which cooperates with the slide bar to advance the movable jaw toward the fixed jaw and increase the clamping pressure between them.

11 Claims, 3 Drawing Sheets

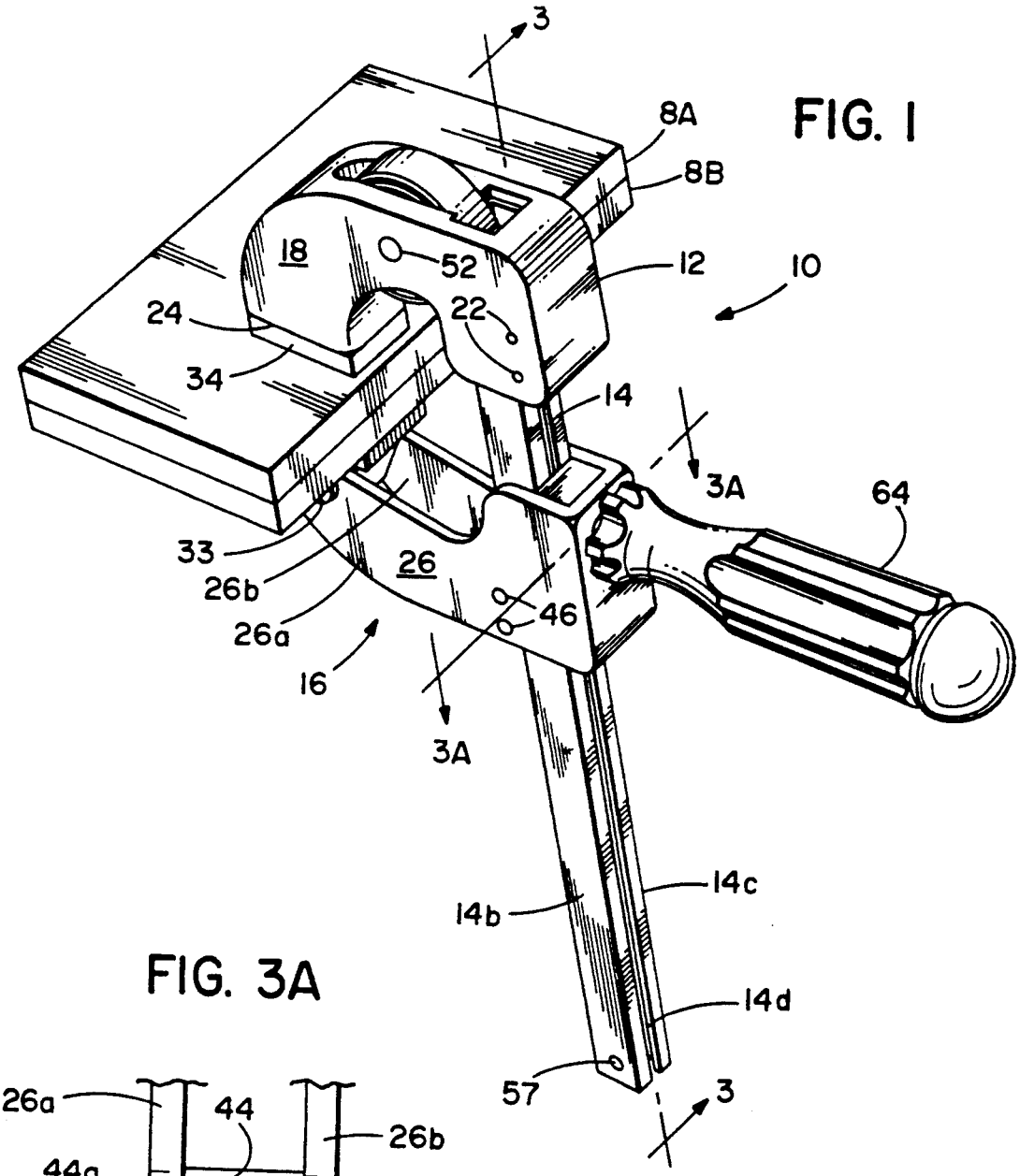
FIG. 1
FIG. 3A
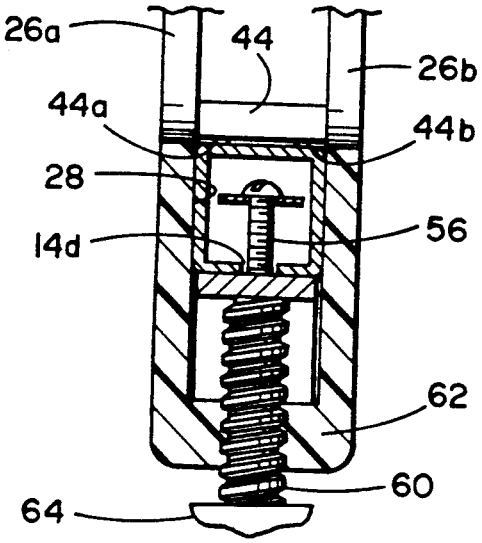

SELF-POWERED BAR CLAMP

BACKGROUND OF THE INVENTION

This invention relates generally to bar clamps of the type used to temporarily clamp two articles together, for example, for gluing, or to hold a work-piece for welding or other operation, and more particularly to a quick-action bar clamp wherein the moving jaw is normally spring-biased toward the stationary jaw by a self-contained tension spring.

Bar clamps of the various configurations are old and well-known. A relatively recent entry into the prior art is the quick-action bar clamp disclosed in U.S. Pat. Nos. 4,926,722 and 5,005,449 and marketed by Peterson Manufacturing Co., Inc. as its "Quick-Grip" clamp. The clamp has a movable jaw which is rapidly movable over both short and long distances to clamp against a work-piece, and is operable with one hand. The movable jaw is connected to one end of a movable slide bar and a stationary jaw is supported on the slide bar by a support structure including a trigger handle grip which releasably engages the slide bar and advances the movable jaw toward the fixed jaw. The trigger mechanism provides a one-way drive which normally precludes moving the slide bar and movable jaw away from the fixed jaw; the movable jaw can be moved in the opposite direction only when the one-way drive mechanism is disengaged.

A disadvantage in the "Quick-Grip" clamp lies in the fact that once the jaws are initially clamped against a work-piece the construction of the lever mechanism is such that the hand cannot exert sufficient force on the trigger handle to advance the movable jaw by another increment, with the consequence that the clamp lacks the power to adequately clamp two articles together.

In other known forms of bar clamps the moving jaw is entirely disengaged and free to move on one or more slide bars until the final tightening of an object between the movable and fixed jaws is accomplished, making its use cumbersome and imprecise.

Thus, there is a need for a bar clamp having a movable jaw which is rapidly movable from any point on a slide bar to clamp a work-piece against a fixed jaw and is capable of providing large clamping forces.

SUMMARY OF THE INVENTION

Briefly, the bar clamp in accordance with the present invention includes a fixed jaw secured to one end of a slide bar and a movable jaw opposing the fixed jaw and mounted to the slide bar for movement therealong toward and away from the fixed jaw. The movable jaw is normally urged into contact with the fixed jaw by a tension spring, which may take the form of a flat coil spring of the type used in roll-up steel rules, which exhibits substantially uniform tension for all displacements of the movable jaw from the stationary jaw. In use, the operator pulls the jaws apart, against the tension of the spring, a distance sufficient to receive the work-piece to be clamped and then releases the movable jaw whereupon the work-piece is clamped between the two jaws. The spring tension provides a clamping force sufficient to hold the clamp on the work-piece regardless of the orientation of the clamp, thereby freeing both hands of the operator. The clamping force is increased by a desired amount over that provided by the tension spring by a screw mechanism associated with the movable jaw which moves the movable jaw, with a continuous motion, toward the stationary jaw and also locks the movable jaw until it is released. The clamp is released by releasing the screw and pulling the two jaws apart.

Accordingly, it is an object of this invention to provide an improved quick-action bar clamp having a movable jaw which may be rapidly moved in either direction along the slide bar.

Another object of the invention is to provide a self-powered quick-action bar clamp having a movable jaw which may be rapidly and precisely advanced from any position toward a fixed jaw and holds itself on a work-piece regardless of orientation of the clamp.

Still another object of this invention is to provide an improved quick-action clamp which is initially self-holding so as to free both hands of the user.

Yet another object of this invention is to provide an improved quick-action bar clamp having a movable jaw which may be rapidly advanced and exerts sufficient force on a work-piece clamped between it and a fixed jaw to hold the clamp to the work-piece so as to free both hands of the user and wherein the movable jaw may be precisely advanced for increasing the clamping pressure between the jaws.

BRIEF DESCRIPTION OF THE DRAWINGS

Other objects, features and advantages of the invention will become apparent, and its construction and operation better understood, from the following detailed description taken in conjunction with the accompanying drawings, in which:

FIG. 1 is a perspective view of a quick-action bar clamp constructed in accordance with the invention shown in clamping engagement with a work-piece;

FIG. 3A is a sectional view taken along line 3A—3A of FIG. 1;

DESCRIPTION OF THE PREFERRED EMBODIMENT

Figure 3:
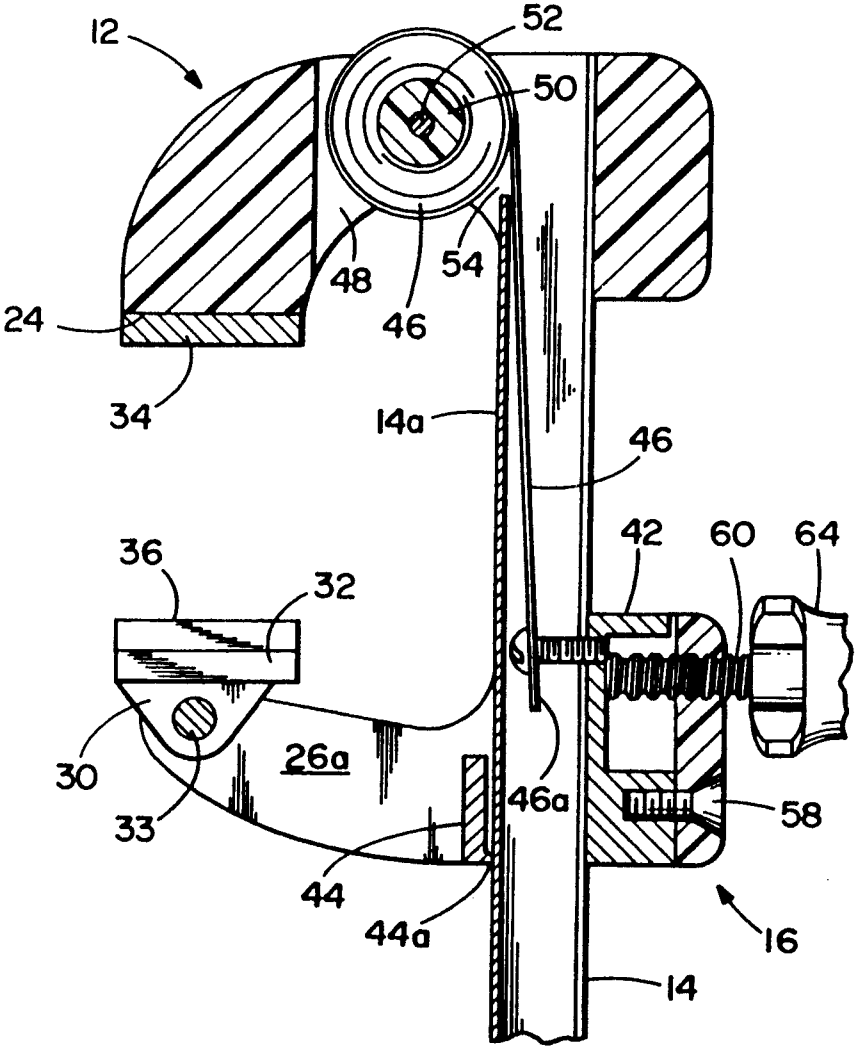
FIG. 3 is a sectional view taken along line 3—3 of FIG. 1.
Figure 2:
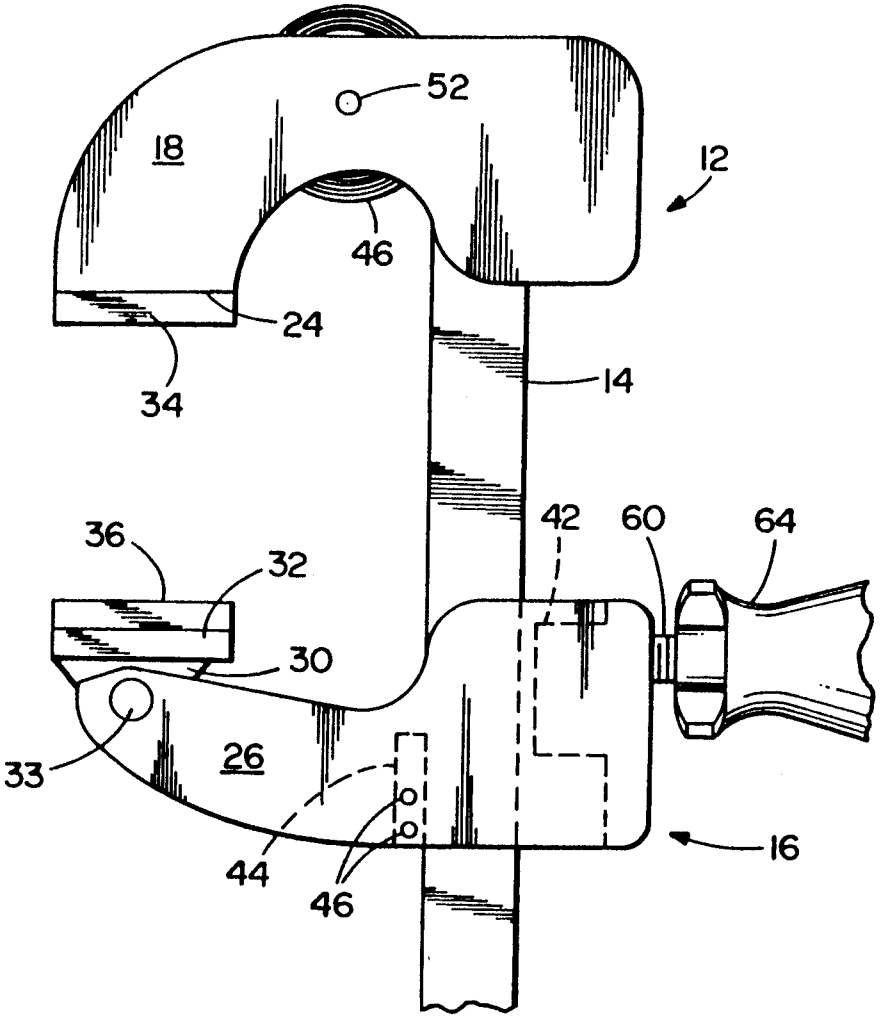
FIG. 2 is a side view of the clamp of FIG. 1.

Referring to the drawings, the quick-acting clamp 10 according to the invention, shown in FIG. 1 clamping two work-pieces 8A and 8B together, has a fixed jaw 12 secured to one end of a slide bar 14, and a movable jaw 14 mounted to the slide bar for movement therealong toward and away from the fixed jaw. The fixed jaw 12 includes a support member 18 having formed therein a rectangular cavity 20 in which one end of the slide bar is received with a press fit. The support member 18 is secured to the slide bar by one or more pins 22 which pass through openings in the member 18 and the slide bar. The longitudinal axis of support member 18, and also the plane of the clamping surface 24 of the fixed jaw, are disposed at right angles to the longitudinal axis of slide bar 14.

The movable jaw 16 includes a support member 26 having a rectangular opening 28 therethrough dimensioned to receive slide bar 14 with a sliding fit. The longitudinal axis of support member 26 extends generally perpendicularly with respect to the longitudinal axis of the slide bar and has a bifurcate outer end for receiving a jaw member 30 between its spaced apart arms 26*a* and 26*b*. The jaw member 30, which is free to swivel about a pivot pin 33, has a clamping surface 32 which opposes the clamping surface 24 of the fixed jaw. If desired, the clamping surfaces 24 and 32 may have protective pads 34 and 36 attached thereto or, alternatively, pads shaped to grip a specially-shaped work-piece may be substituted for the protective pads.

The slide bar 14 is shown as a hollow tubular steel bar of square cross-section having a top wall 14*a* and adjacent sidewalls 14*b* and 14*c* and an elongated slot 14*d* in the wall opposite the top wall. Alternatively, the bar 14 may have an inverted-U cross-section and is preferred because of its relatively low fabrication cost while still providing adequate strength and stiffness. The slide bar may be any of several different lengths depending on the desired gripping capacity of the clamp, being approximately three inches longer than the gripping capacity. That is, a bar nine inches long is needed for a clamp having a maximum spacing of six inches between the clamping surfaces 24 and 32, and a 12-inch capacity clamp would require a fifteen-inch bar.

As best seen in FIGS. 3 and 3A, the rectangular opening 28 through which slide bar 14 extends is defined by the sidewalls of support member 26, a block formed of metal 42 encased within support member and forming the bottom of the opening, and a hardened steel bar 44 which extends transversely of the bar, between the arms 26*a* and 26*b* of support member 26 and secured in place by a pair of pins 46 which extend through aligned openings in support member 26 and bar 44. The opening 28 is dimensioned so that the movable jaw moves freely on the bar 14.

In accordance with an important feature of the invention, the movable jaw structure is normally spring-biased toward the fixed jaw structure by a flat coil spring 46 which is supported on a dowel 50 which, in turn, is supported on a pin 52 extending transversely across a cavity 48 formed in the support structure 18. The spring passes through a slot 54 formed in the upper wall of bar 14, extends along the interior of the bar and its free end 46*a* is secured to the movable jaw structure by a screw 56 threaded into the metal member 42 of the movable jaw structure. The spring 46 is a coil of flat steel ribbon which has been heat-treated to a spring temper so that when it is unwound, as by pulling the movable jaw away from the fixed jaw, it wants to return to its original coiled condition. Springs of this type, known as negator springs, are widely used in roll-up steel rules and other devices, and are commercially available in a variety of lengths, widths, thicknesses and tensions. Such springs characteristically exhibit a substantially constant tension force irrespective of the length of the uncoiled portion, whereby to provide in a 6-inch clamp, for example, substantially the same clamping force on a 5-inch thick work-piece as on a work-piece that is ½-inch thick, or less. By way of example, the steel ribbon of the spring may be ½-inch wide and of a thickness to provide sufficient tension to hold the clamp on a work-piece however oriented, including clamped to an overhead beam, and of sufficient length that the movable jaw can be moved to the extreme end of the slide bar, limited only by a transverse pin 57 extending across the bar.

In use, an operator grasps the fixed jaw structure in one hand, the curved cutout formed in the front of support structure 18 being provided to facilitate grasping it when the clamp is closed, and the movable jaw in the other, and pulls them apart against the tension of the spring a distance sufficient to receive a work-piece between them. When the clamping surfaces have been oriented as desired relative to the work-piece and the movable jaw released, the spring, wanting to return to its original coiled condition, precisely advances it into firmer engagement with the work-piece and provides sufficient clamping pressure between the jaws 24 and 32 to self-hold the clamp in place on the work-piece. This frees both hands of the operator to adjust, if necessary, the relative positions of the clamp and work-piece, and to actuate drive means embodied in the movable jaw structure (to be described presently) for increasing the clamping pressure of the clamp over that provided by spring 46.

Figure 4:
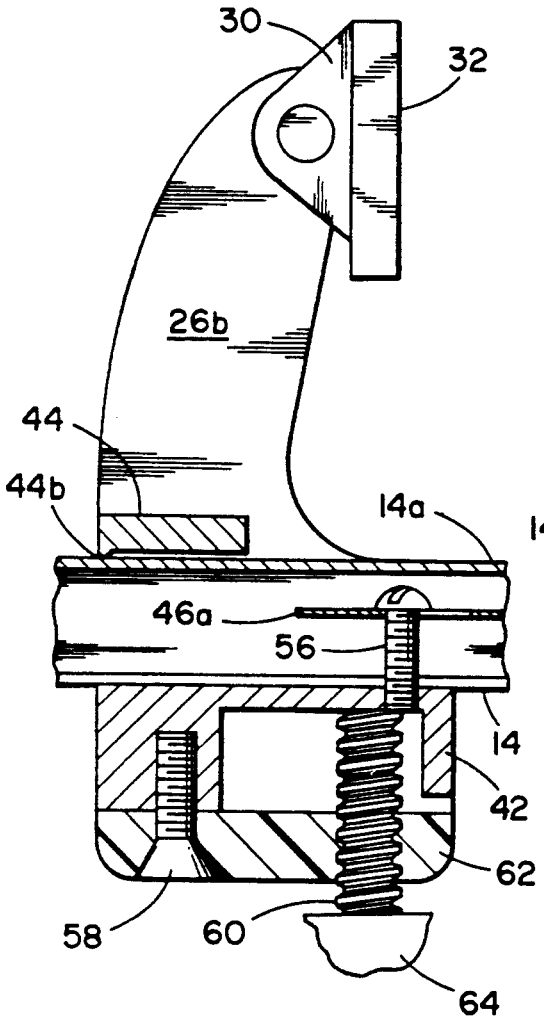
FIG. 4 is an enlarged view, partially in section, which shows the angular position of the movable jaw relative to the slide bar when the drive means is not engaged.
Figure 5:
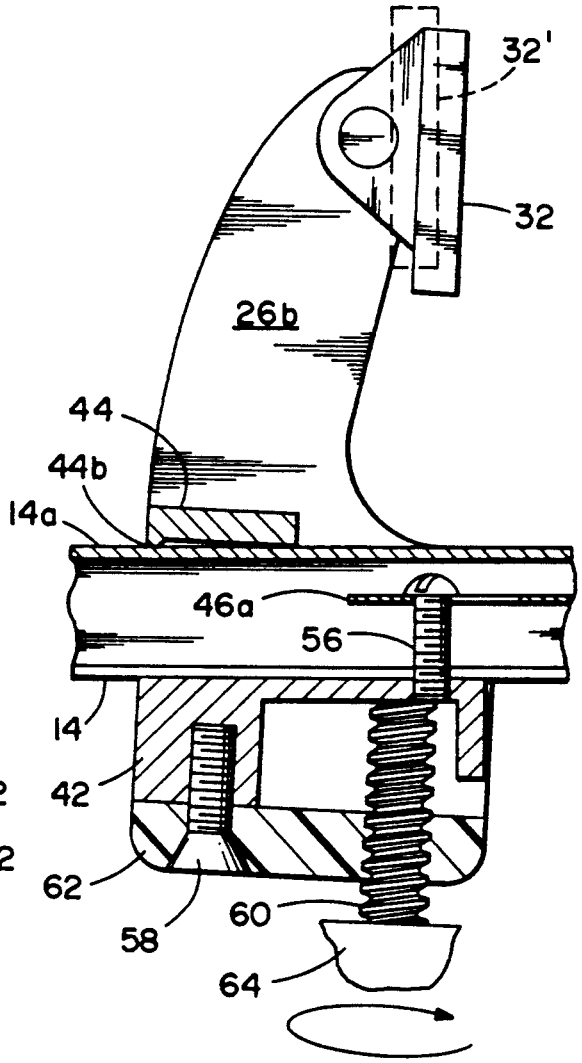
FIG. 5 is an enlarged view, partially in section, which shows the angular position of the movable jaw relative to the slide bar when the drive means is engaged.

As best seen in FIGS. 3A, 4 and 5, the metal member 42 is secured within the lower end of support structure 18 with a screw 58, and has an inverted-U-shaped cavity formed therein; the spring securing screw 56 is threaded into the upper wall of the cavity, and the inner end of a screw 60, threadably engaging a plate 62 which closes the lower end of support structure 26, when turned by a suitable handle, such as the screwdriver handle 64, is forced into engagement with the under surface of the upper wall. The location of screw 60 at the underside of slide bar 14, together with the transverse steel member 44 located above the slide bar and rearwardly of the point of connection of the spring to the movable jaw structure, provide drive means which, when engaged with the slide bar, precisely advances the movable jaw toward the fixed jaw and increases the clamping pressure between them over that provided by spring 46 acting alone. More particularly, because spring 46 is connected towards the front of the movable jaw structure 26, when it pulls the movable jaw against a work-piece held between it and the fixed jaw, the longitudinal axis of the movable jaw structure 26 is tilted slightly to the left (as viewed in FIG. 4) which causes sharp teeth 44*a* and 44*b* formed at opposite sides of the back edge of transverse member 44 to dig into the upper surface of slide bar 14 to a sufficient depth as to temporarily lock the movable jaw to the slide bar at the position to which it was pulled by spring 46. Upon tightening screw 60, which preferably has square threads and typically may be ⅜-inch in diameter and have 24 threads per inch so as to provide extremely high leverage advantage, its inner end pressing on the underside of the upper wall of structure 42 causes the entire movable jaw structure to be tilted toward the work-piece and the teeth on transverse bar 44 to dig even deeper into the upper surface of the slide bar. Tightening screw 60 by two or three turns tilts the movable jaw structure and moves its clamping member 30 toward the right from the position shown in FIG. 4, and by dotted lines in FIG. 5, to the solid-line position shown in FIG. 5; because of the small angle of incline of the screw thread the clamping surface 32 exerts tremendous force, on the order of 500 to 1,000 pounds, on the clamped work-piece. Loosening of screw 60 uncocks and releases the movable support structure to allow it to move freely back along the slide bar for release of the work-piece.

Because the clamping member 32 of the movable jaw structure is free to swivel about pin 33, the plane of its clamping face always assumes a position parallel to the plane of the opposing face 24 of the stationary jaw structure for all situations that might be encountered; namely, when the tool is not in use; when a work-piece is initially held by spring action alone; and for all angles of tilt of the movable jaw structure.

While in the illustrated embodiment the slide bar 14 is formed of steel and has a rectangular cross-section, alternatively the slide bar may be formed of high-strength plastic material and may have other shapes, with the cavities in the support structures for the fixed and movable jaws appropriately shaped for attachment to and movement along the bar, respectively. The support structures may be formed of any suitable material including metal and plastic and, in alternative embodiments may have a different profile, and means other than the curved cutouts may be provided for facilitating grasping of the jaws to pull them apart.

It will have become apparent from the foregoing description that the clamping tool in accordance with the invention is compact, it closes very rapidly from an open to a clamping position, it has the ability to hold itself on a work-piece so as to free both hands of the operator, and provides extremely high clamping forces. The components of the tool are relatively thin and the overall length of the clamp is only approximately three inches longer than the capacity of the clamp over a range of different sizes. That is to say, clamps having differing maximum openings between the jaws can be provided simply by changing the length of the slide bar, and in all cases the overall length is no more than about three inches greater than the maximum opening.

It will now be evident to ones skilled in the art that certain modifications and changes, in addition to the alternatives already mentioned, may be made in the described construction without departing from the spirit and scope of the invention. For example, the locking screw may be positioned on the movable jaw structure at a location to engage the top wall of the slide bar. It is intended that all matter contained in the above description or shown in the accompanying drawings shall be interpreted as illustrative and not in a limiting sense.

I claim:

1. A quick-acting bar clamp comprising:

an elongate slide bar;

a fixed jaw and first support means for securing said fixed jaw to one end of said slide bar;

a movable jaw and second support means for mounting said movable jaw on said slide bar for movement therealong toward and away from said fixed jaw;

means including extensible tension spring means connected between said first and second support means for normally pulling said movable jaw toward said fixed jaw, wherein the tension of said spring means is sufficient to self-hold said clamp to a work-piece clamped between its jaws irrespective of orientation while allowing said jaws to be pulled apart by hand, whereby upon release of either jaw after having been pulled apart against the tension of said spring means a distance sufficient to receive a work-piece said spring means rapidly advances said movable jaw toward said fixed jaw for clamping the work-piece between them with a pressure corresponding to the tension of said spring means; and means supported on said second support means for releasably engaging said slide bar and, when engaged, for greatly increasing the clamping pressure between said jaws over that exerted by said tension spring means alone.

2. A quick-acting clamp as defined in claim 1, wherein said tension spring means is a flat coil spring supported on said first support means and having a free end connected to said second support means and wherein said spring means exhibits substantially uniform tension over the range of distances that the jaws may be pulled apart.

3. A quick-acting clamp as defined in claim 2, wherein said slide bar is a hollow tubular bar having a top wall and at least adjacent first and second side walls; and wherein said flat coil spring is mounted on a pin passing through said first support means transversely of said slide bar, and wherein said spring extends through a transverse slot formed in the upper wall of said slide bar and interiorly of said slide bar for connection at a free end to said second support means.

4. A quick-acting bar clamp as defined in claim 1, wherein said drive means, when engaged, tilts said second support means toward said fixed jaw, and wherein said movable jaw is pivotally supported on said second support means for maintaining parallelism between said movable jaw and said fixed jaw for all angles of tilt of said second support means.

5. A quick-acting clamp as defined in claim 1, wherein said first and second support means each has a front portion facing a front portion of the other, wherein a longitudinal axis of each said first and second support means is substantially perpendicular to a longitudinal axis of said slide bar, and wherein said first and second support means each includes means for facilitating hand-grasping the support means and pulling said movable jaw away from said fixed jaw.

6. A quick-acting clamp as defined in claim 5, wherein the front portion of each of said first and second support means has a curved cutout for receiving one or more fingers of a user of the clamp.

7. A quick-acting clamp as defined in claim 2, wherein said free end of said coil spring is connected to said second support means at a point near a front portion thereof for causing said second support means to tilt away from a work-piece clamped between said fixed jaw and said movable jaw, and wherein said drive means, when actuated, tilts said second support means toward a work-piece clamped between said fixed and movable jaws.

8. A quick-acting clamp as defined in claim 7, wherein said drive means comprises a bar extending transversely of a rear portion of said second support means for engaging a top wall of said slide bar when said second support means is tilted away from a clamped work-piece, and means including a screw threadably engaged in said second support means which, when tightened, tilts said second support means and said movable jaw toward said clamped work-piece for increasing the clamping pressure between said fixed and movable jaws over the pressure exerted by said coil spring.

9. A quick-acting bar clamp comprising:

an elongate tubular slide bar of rectangular cross-section having a top wall, sidewalls and an elongate slot opposite the top wall;

a fixed jaw having a clamping surface and first support means for securing said fixed jaw to one end of said slide bar with its clamping surface oriented perpendicularly to a longitudinal axis of said slide bar;

a movable jaw having a clamping surface and second support means for mounting said movable jaw on said slide bar for movement therealong toward and away from said first support means, wherein said movable jaw is pivotally supported on said second support means with its clamping surface opposing the clamping surface of said fixed jaw;

means including a partially unwound spring supported on said first means and which extends interiorly of said slide bar and is secured at a free end to said second support means for normally biasing said movable jaw toward and into contact with said fixed jaw, whereby movement of said movable jaw away from said fixed jaw to receive a work-piece therebetween further unwinds said coil spring which, when the movable jaw is released, rewinds and rapidly advances said movable jaw along said slide bar into contact with said work-piece for clamping the work-piece between said movable and fixed jaws with a pressure which corresponds to the tension of said coil spring; and drive means including a screw threadably engaging said second support means for releasably engaging said slide bar which, when actuated, locks said second support means to said slide bar at a position to which it was advanced by said coil spring and tilts said second support means toward said fixed jaw for increasing the clamping pressure between said fixed and movable jaws over that exerted by said coil spring.

10. A quick-acting clamp as defined in claim 9, wherein the tension of said coil spring is sufficient to self-hold said clamp to a work-piece irrespective of orientation and exhibits substantially uniform tension over the maximum range of movement of said second support means along said slide bar.

11. A self-powered quick-acting clamp comprising:

an elongate hollow tubular slide bar having a U-shaped cross-section;

a fixed jaw having a clamping surface secured to one end of said slide bar;

a movable jaw having a clamping surface slidably mounted on said slide bar for movement therealong toward and away from said fixed jaw;

a partially unwound flat coil spring supported at said fixed jaw which extends interiorly of said slide bar and has a free end connected to said movable jaw for normally pulling the clamping surface of said movable jaw toward the clamping surface of said fixed jaw, wherein the tension of said spring is substantially uniform over the maximum range of movement of said movable jaw and sufficient to self-hold said clamp to a work-piece irrespective of orientation while allowing the jaws to be pulled apart by hand, whereby upon release of either jaw after having been pulled apart against the tension of said spring a distance sufficient to receive a work-piece said spring rapidly advances said movable jaw toward said fixed jaw to clamp the work-piece between their respective clamping surfaces with a pressure corresponding only to the tension of said spring; and means supported on said movable jaw for releasably engaging said slide bar, said means being user-operated following initial clamping of a work-piece by only the tension of said coil spring and, when operated, greatly increases the clamping pressure over that exerted by the tension of said spring along.

* * * * *